US009222721B2

(12) United States Patent
Kim

(10) Patent No.: US 9,222,721 B2
(45) Date of Patent: Dec. 29, 2015

(54) CLEAN WATER FILTER ASSEMBLY OF REFRIGERATOR

(75) Inventor: Seongwook Kim, Changwon (KR)

(73) Assignee: LG ELECTRONICS INC., Seoul (KR)

( * ) Notice: Subject to any disclaimer, the term of this patent is extended or adjusted under 35 U.S.C. 154(b) by 1084 days.

(21) Appl. No.: 12/989,163

(22) PCT Filed: Jan. 2, 2009

(86) PCT No.: PCT/KR2009/000011

§ 371 (c)(1),
(2), (4) Date: Oct. 22, 2010

(87) PCT Pub. No.: WO2009/131296

PCT Pub. Date: Oct. 29, 2009

(65) Prior Publication Data

US 2011/0036765 A1 Feb. 17, 2011

(30) Foreign Application Priority Data

Apr. 24, 2008 (KR) ..... 10-2008-0038210

(51) Int. Cl.
*B01D 29/00* (2006.01)
*F25D 23/12* (2006.01)

(52) U.S. Cl.
CPC ..... *F25D 23/126* (2013.01); *F25D 2323/121* (2013.01)

(58) Field of Classification Search
CPC ..... B01D 27/00; B01D 27/08; B01D 35/30; B01D 35/306; B01D 46/0004; B01D 46/0005; B01D 2201/30; B01D 2201/301; B01D 2201/205; B01D 2201/306; B01D 2201/307; B01D 2201/4023; B01D 35/303; C02F 2307/12; C02F 2307/10; C02F 2307/06; C02F 2307/04; C02F 9/005; C02F 2201/006; C02F 1/003; F25D 2323/121
USPC ..... 210/232, 238, 249; 464/167; 62/67; 222/189.06
See application file for complete search history.

(56) References Cited

U.S. PATENT DOCUMENTS

| | | | | |
|---|---|---|---|---|
| 4,670,144 | A * | 6/1987 | McCausland et al. | 210/244 |
| 7,261,815 | B2 * | 8/2007 | Cur et al. | 210/232 |
| 2007/0012611 | A1 * | 1/2007 | An | 210/232 |

FOREIGN PATENT DOCUMENTS

| | | | |
|---|---|---|---|
| KR | 1999-0031494 | A | 5/1999 |
| KR | 10-2005-0105347 | A | 11/2005 |
| KR | 10-2007-0040119 | A | 4/2007 |
| KR | 100817004 | * | 3/2008 |
| WO | WO2008062948 | * | 5/2008 |

OTHER PUBLICATIONS

English machine translation KR100817004, Yoon, Mar. 27, 3008, pp. 1-3.*

* cited by examiner

*Primary Examiner* — Nam Nguyen
*Assistant Examiner* — Claire Norris
(74) *Attorney, Agent, or Firm* — Birch, Stewart, Kolasch & Birch, LLP

(57) ABSTRACT

Disclosed is a clean water filter of a refrigerator, comprising: a clean water filter allowing water flowed into the refrigerator to be cleaned; a filter head to which the clean water filter is detachably coupled; a rotation cover rotatably coupled to the filter head and provided to receive at least a portion of the clean water filter and filter head; and a rotation part formed on a side of the filter head and allowing the rotation cover to be rotated with respect to the filter head, wherein the rotation cover rotates centering on a shaft parallel to the length direction of the clean water filter. With the present embodiment, the radius of rotation of the rotation cover is formed to be small, making it possible to minimize interference between the rotation cover and the stored goods.

10 Claims, 2 Drawing Sheets

CLEAN WATER FILTER ASSEMBLY OF REFRIGERATOR

TECHNICAL FIELD

The present embodiment relates to a clean water filter assembly of a refrigerator.

BACKGROUND ART

Generally, a refrigerator is a home appliance which maintains the temperature of an inside of the refrigerator to be lower than the temperature of a room to enable food in a cold storage or a freezing storage to be stored for a long time.

Generally, a refrigerator includes a freezing chamber and a refrigerating chamber, wherein various foods required to be a cold storage are stored in the inside of the refrigerating chamber. And, in order to take out foods stored in the inside of the refrigerating chamber, a refrigerating chamber door should be opened. When opening the refrigerating chamber door, there is a disadvantage that internal cold air is discharged to the external and at the same time, high temperature external air is flowed in.

Therefore, a refrigerator whose door surface has a dispenser has been developed and has been sold so that water stored in the inside of the refrigerating chamber can be taken out to the external without opening the refrigerating chamber door. And, a user can conveniently use the refrigerator by taking out water or ice through the dispenser.

Meanwhile, a clean water filter assembly has been recently provided in a refrigerator so that water supplied form the external can be cleaned. And, the water cleaned in the clean water filter assembly is supplied rightly to an ice-making apparatus to make ice or to be supplied to a user through the dispenser.

Generally, the clean water filter assembly is horizontally or vertically installed in an inner case of the inside of the refrigerator.

The clean water filter assembly generally includes a clean water filter cleaning flowed water and a filter cover receiving the clean water filter and preventing approach of dirt to the clean water filter.

Meanwhile, when stored goods are stored in the refrigerating chamber, particularly, when the stored goods are stored in the range where the filter cover rotates, there has been a problem that the filter cover interferes in the stored goods.

In other words, there has been a problem that the filter cover contacts foods so that the foods and the filter cover have bad sanitation.

To the contrary, in the case that a user moves foods whenever the clean water filter is mounted or replaced, there is a problem that the user feels very inconvenient.

When stored goods are not stored around the filter cover in order to avoid the problem as above, it causes another problem that the space efficiency of the refrigerating chamber of the refrigerator becomes bad.

DISCLOSURE OF INVENTION

Technical Problem

The present embodiment is proposed to solve the problems. It is an object of the present invention to provide a clean water filter assembly of a refrigerator allowing a space in the refrigerator to be efficiently utilized by improving a cover structure of the clean water filter assembly of the refrigerator.

Also, it is another object of the present embodiment to provide a clean water filter assembly capable of minimizing interference with stored goods stored in a storage chamber of a refrigerator by minimizing a rotation range of the filter cover.

Technical Solution

In order to accomplish the objects, according to one aspect of the present embodiment, there is provided a clean water filter of a refrigerator comprising: a clean water filter allowing water flowed into the refrigerator to be cleaned; a filter head to which the clean water filter is detachably coupled; a rotation cover rotatably coupled to the filter head and provided to receive at least a portion of the clean water filter and filter head; and a rotation part formed on a side of the filter head and allowing the rotation cover to be rotated with respect to the filter head, wherein the rotation cover rotates centering on a shaft parallel to the length direction of the clean water filter.

According to another aspect of the present embodiment, there is provided a clean water filter assembly comprising: a clean water filter allowing water flowed into the refrigerator to be cleaned; a filter head to which the clean water filter is detachably coupled; and a filter cover shielding the lower part of the clean water filter, wherein the filter cover comprises: a cover main body fixed along the length direction of the clean water filter; and a rotation cover rotatably coupled to the lower side of the cover main body and having a first direction longer than a second direction, wherein the rotation cover rotates using the length of the second direction as the radius of rotation.

Advantageous Effects

With the proposed embodiments, the filter cover rotates centering on a length direction shaft of the clean water filter by improving the cover structure of the clean water filter assembly of the refrigerator, making it possible to minimize the interference with the stored goods stored in the storage chamber of the refrigerator.

Also, the filter cover does not contact the stored goods by minimizing the rotation range of the filter cover, making it possible to improve sanitation of the filter cover and the stored goods.

Also, the inconvenience to move the stored goods whenever the clean water filter is mounted or replaced disappears, making it possible to improve a user's reliability for the product.

Also, a separate room space around the filter cover is not required when the clean water filter is mounted or replaced, making it possible to sufficiently secure the storage space of the stored goods.

MODE FOR THE INVENTION

Hereinafter, the present embodiment will be described in more detail with reference to the accompanying drawings. However, the idea of the present invention is not limited to the embodiments set forth herein but a person having ordinary skill in the art to which the present invention pertains can easily propose another embodiment within the scope of the same idea.

Figure 1:
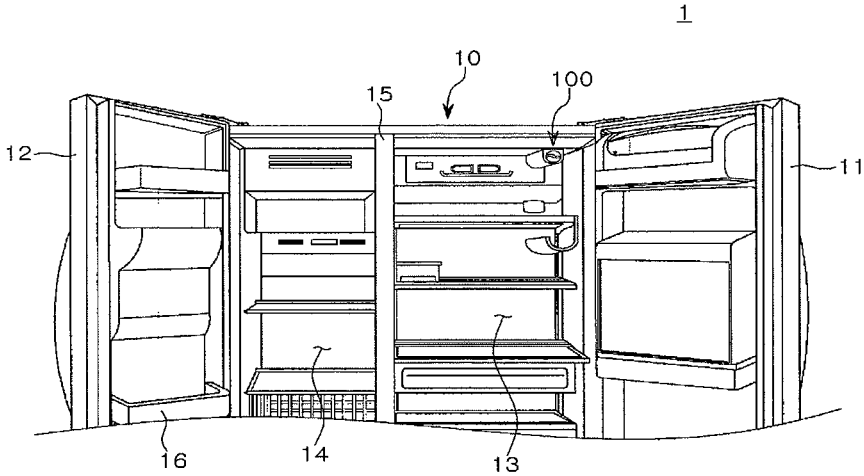
FIG. 1 is a perspective view showing a refrigerator equipped with a filter assembly according to an embodiment of the present invention.

FIG. 1 is a perspective view showing a refrigerator equipped with a filter assembly according to an embodiment of the present invention.

Referring to FIG. 1, the refrigerator 1 according to the present invention includes a main body 10 in which cold air is stored, and a refrigerator door 11 and a refrigerating door 12 rotatably installed to the front of the main body 10 and selectively opening and closing a refrigerating chamber and a freezing chamber, respectively.

Hereinafter, a side by side type refrigerator in which a freezing chamber and a refrigerating chamber are provided left and right each other will be described by way of example. However, the idea of the present invention is not limited thereto, but may be applied to both a top mount type refrigerator in which a freezing chamber is provided at an upper side of a refrigerating chamber, and a bottom freezer type refrigerator in which a freezing chamber is provided at a lower side of a refrigerating chamber.

More specifically, the main body 10 includes a refrigerating chamber 13 in which the stored goods are held in chilled storage and a freezing chamber 14 in which the stored goods are held in cold storage. And, the refrigerating chamber 13 and the freezing chamber 14 may be partitioned by a partitioning part 15.

The partitioning part 15 may be filled with insulating material for insulating the refrigerating chamber 13 and the freezing chamber 14.

A plurality of shelves keeping foods may be provided in the refrigerating chamber 13 and the freezing chamber 14. And, a plurality of storage baskets 16 keeping foods are provided in a refrigerating chamber door 11 and a freezing chamber door 12. Here, stored goods having a long length such as a bottle may be stored in the storage basket 16.

Meanwhile, a filter assembly 100 cleaning water supplied from the external is provided in the refrigerating chamber 13.

The filter assembly 100 may be arranged in the depth direction of the refrigerator 13, that is, in the forward and backward directions of the storage chamber. However, the arrangement direction of the filter assembly 100 is not limited to the directions as above, but may be arranged in the horizontal direction to the side of the storage chamber.

Here, the filter assembly 100 may be fixed on an inner wall of the refrigerator 13, that is, on one side surface of the inner case of the refrigerator 13.

Figure 2:
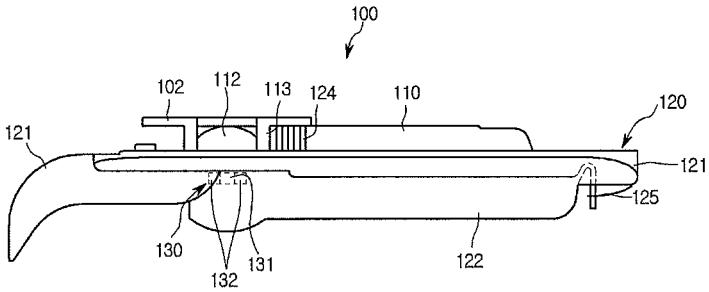
FIG. 2 is a side view showing a filter assembly according to an embodiment of the present invention.
Figure 3:
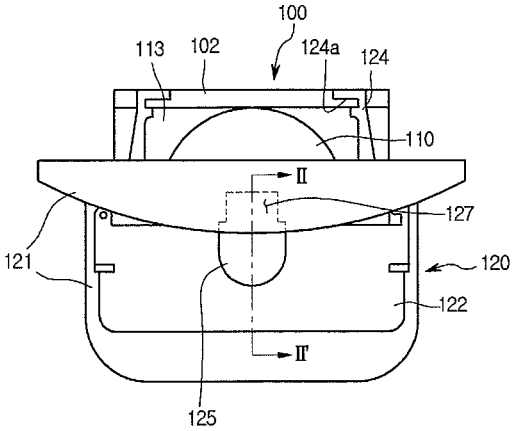
FIG. 3 is a front view of a filter assembly whose filter cover according to an embodiment of the present invention is closed.
Figure 4:
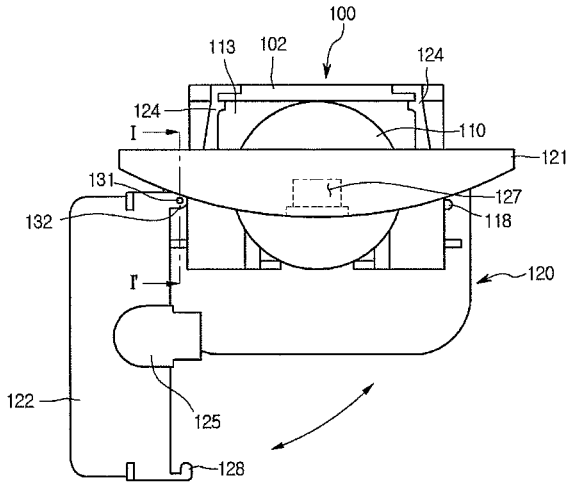
FIG. 4 is a front view of a filter assembly whose filter cover according to an embodiment of the present invention is opened.

FIG. 2 is a side view showing a filter assembly according to an embodiment of the present invention, FIG. 3 is a front view of a filter assembly whose filter cover according to an embodiment of the present invention is closed, and FIG. 4 is a front view of a filter assembly whose filter cover according to an embodiment of the present invention is opened.

Referring to FIGS. 2 to 4, the filter assembly 100 according to the present embodiment includes a clean water filter 110 cleaning water, a filter head 112 detachably coupled to the clean water filter 110, and a filter cover 120 provided on an external side of the clean water filter 110 and the filter head 112.

More specifically, in the filter head 112 an inlet pipe (not shown) allowing water to be supplied to the clean water filter 110 and an outlet pipe (not shown) allowing water cleaned in the clean water filter 110 to be discharged may be provided.

In front of the filter head 112, a head front surface part 113 forming a front surface external appearance of the filter head 112 is provided, and on the upper side of the filter head 112, a fixing part 102 allowing the filter assembly 100 to be fixed on an inner wall of the refrigerating chamber 113 is provided.

Here, the filter head 112, the head front surface part 113, and the fixing part 102 may be integrally formed. And, the fixing part 102 may be formed on the inner wall of the refrigerating chamber 113 by an engagement member (not shown).

The clean water filter 110 may be coupled to the filter head 112 in a rotation manner. In other words, the clean water filter 110 may be coupled to the filter head 112 by being rotated in a state where it is inserted into an end of one side of the filter head 112.

Meanwhile, the filter cover 120 is provided with a cover main body 121 arranged along the forward and backward directions of the clean water filter 110 to form the external appearance of the filter cover 120, and a rotation cover 122 rotatably provided on the lower side of the cover main body 121.

The rotation cover 122 is provided to surround the lower part of the clean water filter 110. Therefore, the inner side surface of the rotation cover 122 may have a shape corresponding to the outer circumferential surface of the clean water filter 110.

The direction in the clean water filter assembly 100 will be defined. The length direction of the clean water filter 110, that is, the right and left directions seen from FIG. 2, will be referred to as "first direction". And, the width direction of the clean water filter 110, that is, the horizontal direction seen from FIG. 2, will be referred to as "second direction".

The forward and backward length of the clean water filter 110 is formed to be longer than the horizontal width thereof. In other words, in the clean water filter 10, the size of the first direction is formed to be longer than that of the second direction.

The rotation cover 122 has the shape corresponding to the clean water filter 110 so that the forward and backward length, that is, the size of the first direction, is formed to be longer than the horizontal width, that is, the size of the second direction.

Meanwhile, the rotation cover 122 is hinge-coupled to the side of the filter head 112.

More specifically, in the rotation cover 122 and the filter head 112, a rotation part 130 allowing the rotation cover 120 to be rotatably coupled is formed.

In the rotation part 130, a rotation centering part 131 provided to the filter head 112 and protruded from one side surface of the filter head 112 to the external to form a rotation center of the rotation cover 122 is included.

In the rotation part 130, rotation projections 132 provided in the inner side surface of the rotation cover 122 and inserted into both sides of the rotation centering part 131 is further included. And, inserting grooves (to be described later) may be formed in the rotation projections 132 so that both side ends of the rotation centering part 131 can be inserted. The rotation projections 132 may have a cylindrical shape as a whole.

Here, the rotation centering part 131 and the rotation projections 132 may be arranged in the direction parallel to the length direction shaft of the clean water filter 110. In other words, the rotation cover 122 may rotate centering on the length direction shaft of the clean water filter 110.

Therefore, the rotation cover 122 can rotate, using a width whose length is relatively short as the radius of rotation, so that its rotation range can be formed to be small. In other words, the rotation range can be formed to be smaller compared to the rotation, using a length of the rotation cover 122 as the radius of rotation.

Summing up, as shown in FIG. 4, seeing from the front of the filter assembly 100, the rotation cover 122 rotates using the horizontal width length of the rotation cover 122 as the radius of rotation. In other words, the rotation cover 122 can rotate in a clockwise direction or a counterclockwise direction based on the length directional center shaft of the clean water filter 110.

Also, in the filter cover 120, a filter coupling part 124 coupling the cover main body 121 to the fixing part 102 is provided.

In the filter coupling part 124, a plurality of stumbling sills that allows the filter coupling part 124 coupled to the fixing part 102 to be firmly fixed without moving rightward and leftward, and upward and downward, may be formed.

The stumbling sills 124*a* may be protruded from the inside of the fixing part 102 and the lower side of the fixing part 102 to one direction.

In the front of the rotation cover 122, a hooking projection 125 inserted into the cover main body 121 in a state where the rotation cover 122 is closed, that is, the lower part of the clean water filter 110 is shielded, is provided.

In the cover main body 121, a hooking groove 127 allowing the hooking projection 125 to be inserted is indented on the position corresponding to the hooking projection 125.

Here, the hooking projection 125 may be made of elastic material so that the rotation cover 122 can be elastically deformed while it is coupled to the cover main body 121.

In the rotation cover 122, a coupling projection 128 coupled to the filter head 112 in a state where the rotation cover 122 is closed, that is, in a state where the rotation cover 122 shields the lower part of the clean water filter 110, is provided.

Here, the coupling projection 128 is formed to be protruded from one side end of the rotation cover 122 to the inner side.

In the filter head 112, a coupling part 118 where a hooking is made with the coupling projection 128 is formed on the position corresponding to the coupling projection 128.

Here, the coupling part 118 may be provided on the opposite side of the rotation centering part 131. In other words, the rotation centering part 131 may be formed on the side of the filter head 112, and the coupling part 118 may be formed on the other side of the filter head 112.

The coupling part 118 is formed to be protruded to the external side of the filter head 112.

The coupling projection 128 and the coupling part 118 are formed to be rounded. And, the coupling projection 128 in a state being contacted to the coupling part 118 is guided to the upper side of the coupling part 118 while the rotation cover 122 is closed. In other words, the coupling projection 128 and the coupling part 118 each have rounded shapes, such that the coupling projection 128 and the coupling part 118 can be easily guided to the upper side of the coupling part 118.

The coupling projection 128 in a state being gaped outward can be guided along the outer surface of the coupling part 118, and it may be returned into its original position if the hooking is completed made. In other words, the coupling projection 128 may be formed of a member having a predetermined elasticity.

The rotation process of the rotation cover 122 will be described.

The rotation cover 122 can rotate centering on the rotation centering part 131 in a state where the lower part of the clean water filter 110 is shielded. During the process, the coupling projection 128 may be released from the coupling part 118, and the hooking projection 125 may be released from the hooking groove 127.

Also, the rotation cover 122 is downwardly opened and closed centering on the length direction shaft of the clean water filter 110, having an advantage that the rotation range can be minimized.

Meanwhile, the rotation cover 122 can rotate in a counterclockwise direction (based on FIG. 4) based on the length directional center shaft of the clean water filter 110 in a state where the lower part of the clean water filter 110 is opened.

It depends on the formation position of the rotation part 130 whether the rotation cover 122 rotates in a clockwise direction or in a counterclockwise direction.

Figure 5:
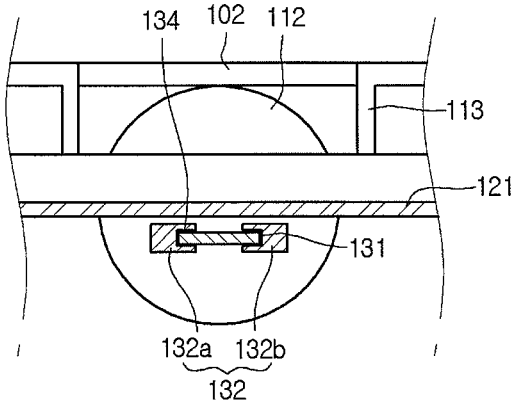
FIG. 5 is a cross-sectional view taken along lines I-I' of FIGS. 2.
Figure 6:
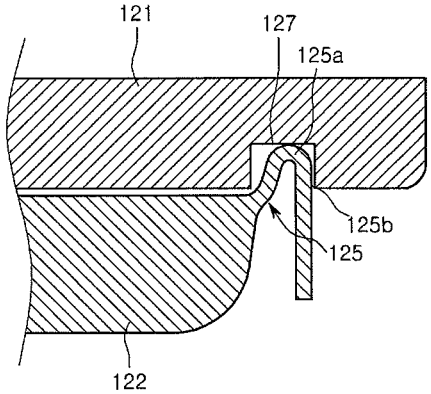
FIG. 6 is a cross-sectional view taken along lines II-II' of FIG. 2.

FIG. 5 is a cross-sectional view taken along lines I-I' of FIG. 2 and FIG. 6 is a cross-sectional view taken along lines II-II' of FIG. 2.

Referring to FIGS. 5 and 6, the rotation cover 122 according to the embodiment of the present embodiment is rotatably coupled to a side of the filter head 112.

In the filter head 112, a rotation centering part 131, which becomes a rotation center of the rotation cover 122, is formed. The rotation centering part 131 in a cylindrical shape is arranged in the forward and backward length directions of the clean water filter 110.

In the rotation cover 122, a first rotation projection 132*a* and a second rotation projection 132*b* insertably provided to both sides of the rotation centering part 131 are provided.

In the rotation projections 132*a* and 132*b*, an insertion groove 134 to which the rotation centering part 131 is inserted is indented, respectively.

The rotation projections 132*a* and 132*b* may have a predetermined elasticity. The respective rotation projections 132*a* and 132*b* may be inserted into both sides of the rotation center 131 in a state where they are gaped in the direction that they are getting far from each other. And, if the rotation projections 132*a* and 132*b* are inserted into the rotation center 131, they can be completely inserted into the rotating center 131, while being returned to their original positions.

Through the constitution as described above, the rotation projections 132*a* and 132*b* can rotate on both sides of the rotation centering part 131. Then, the rotation cover 122 can rotate in a direction that the rotation projections 132*a* and 132*b* rotate.

Meanwhile, the hooking projection 125 can be inserted into the hooking groove 127 of the cover main body 121 in a state where the rotation cover 122 is closed.

The hooking projection 125 may have a hook shape. And, the hooking projection 125 may be elastically deformed, while being inserted into the hooking groove 127.

The hooking projection 125 is provided with a bending part 125*a* formed to be rounded and a pressure part 125*b* extended from the bending part 125*a* to the downward.

The hooking projection 125 is elastically deformed while being inserted into the hooking groove 127, and if the hooking projection 125 is completely inserted into the hooking groove 127, it can be returned into its original position.

The pressure part 125*a* presses the inner side surface of the hooking groove 127 and thus, the hooking can be easily made in the inside of the hooking groove 127.

With the filter assembly 100 according to the present embodiment, the filter cover 120 is rotatably coupled centering on the side of the filter head 112. And, the filter cover 120 can rotate centering on the shaft parallel to the forward and backward length direction of the clean water filter 110.

In other words, the filter cover 120 rotates using a horizontal width whose length is relatively short as the radius of rotation, having an advantage that the rotation range can be minimized.

In other words, it has an effect that the radius of the rotation becomes smaller compared to the case where the filter cover rotates using the forward and backward length of the filter cover that is relatively long. Therefore, while the filter cover rotates, an advantage arises in that the filter cover does not interfere with the foods stored in the storage chamber.

Meanwhile, although not described in the embodiment, in the filter cover 120, an upper cover shielding the upper of the clean water filter 110 may be provided. And, the upper cover may be fixed on the inner side surface of the storage chamber.

Industrial Applicability

With the clean water filter assembly of the refrigerator according to the embodiment as constituted above, the radius of rotation of the filter cover is formed to be small, making it possible to minimize interference of the filter cover in the stored goods stored in the storage chamber. Therefore, its industrial applicability is noticeable.

The invention claimed is:

1. A refrigerator, comprising:

a main body having a storing chamber; and a filter assembly mounted on an inner wall of the main body to allow water flowed into the refrigerator to be cleaned, the filter assembly comprising:

a filter having a cylindrical body to purify the water;

a filter head to which the filter is detachably coupled and having a fixing part coupled to the inner wall of the main body;

a hinge part provided at a first outer side surface of the filter head;

a coupling part provided at a second outer side surface of the filter head, the second outer surface being opposite to the first outer side surface;

a filter cover including a cover body coupled to the fixing part and having a groove and a rotation cover rotatably coupled to the filter head and including an enclosure having a shape corresponding to the cylindrical body of the filter to enclose a lower part of the filter;

at least one rotation projection mounted on an inner surface of the rotation cover and coupled to the hinge part;

a hooking projection mounted on the rotation cover and separably coupled to the groove of the cover body; and a coupling projection mounted on the rotation cover and separably coupled to the coupling part, wherein the coupling projection rotates with a predetermined radius of rotation, which is a distance from the rotation projection to the coupling part, and the rotation cover opens the lower part of the filter when the hooking projection is separated from the groove of the cover body.

2. The refrigerator according to claim 1, wherein the rotation cover has a smaller width than a length, and rotates using the size of the width direction as the radius of rotation.

3. The refrigerator according to claim 1, wherein the hinge part is protruded from one side surface of the filter head, and the rotation projection is protruded from one side surface of the rotation cover.

4. The refrigerator according to claim 1, further comprising a plurality of rotation projections to which two portions of the inner surface of the rotation cover are coupled.

5. The refrigerator according to claim 1, wherein the coupling part coupled to the rotation cover is formed on the second surface of the filter head opposing the hinge part.

6. The refrigerator according to claim 1, wherein the rotation cover includes the coupling projection coupled to the coupling part in a state where the rotation cover is closed.

7. The refrigerator according to claim 1, wherein the hooking projection may be elastically deformed.

8. The refrigerator according to claim 6, wherein the coupling projection and the coupling part are formed to be rounded, the coupling projection being elastically deformable.

9. The refrigerator according to claim 1, wherein the hooking projection is elastically deformable.

10. The refrigerator according to claim 1, wherein the hooking projection is located opposite of the filter head.

* * * * *